United States Patent [19]

Creatura et al.

[11] Patent Number: 5,002,846

[45] Date of Patent: Mar. 26, 1991

[54] DEVELOPER COMPOSITIONS WITH COATED CARRIER PARTICLES

[75] Inventors: John A. Creatura, Ontario; George R. Hsu, Rochester, both of N.Y.

[73] Assignee: Xerox Corporation, Stamford, Conn.

[21] Appl. No.: 491,793

[22] Filed: Mar. 12, 1990

Related U.S. Application Data

[60] Division of Ser. No. 136,791, Dec. 22, 1987, Pat. No. 4,937,166, which is a continuation-in-part of Ser. No. 793,042, Oct. 30, 1985, abandoned.

[51] Int. Cl.[5] ..... G03G 9/10

[52] U.S. Cl. ..... 430/108; 430/109

[58] Field of Search ..... 430/108, 109

[56] References Cited

U.S. PATENT DOCUMENTS

| | | | |
|---|---|---|---|
| 2,890,968 | 6/1959 | Giaimo et al. | 430/110 X |
| 3,668,126 | 6/1972 | Tamai et al. | 430/106 X |
| 4,021,358 | 3/1977 | Tomono et al. | 430/106 |
| 4,297,427 | 10/1981 | Williams et al. | 430/108 |
| 4,306,009 | 12/1981 | Veillette et al. | 430/115 |
| 4,434,220 | 2/1984 | Abbott et al. | 430/108 |

FOREIGN PATENT DOCUMENTS

| | | | |
|---|---|---|---|
| 127569 | 10/1980 | Japan | 430/108 |

*Primary Examiner*—David Welsh
*Attorney, Agent, or Firm*—E. O. Palazzo

[57] ABSTRACT

A carrier composition comprised of a core with a coating thereover comprised of a mixture of first and second polymers that are not in close proximity thereto in the triboelectric series.

9 Claims, 2 Drawing Sheets

DEVELOPER COMPOSITIONS WITH COATED CARRIER PARTICLES

Figure 1:
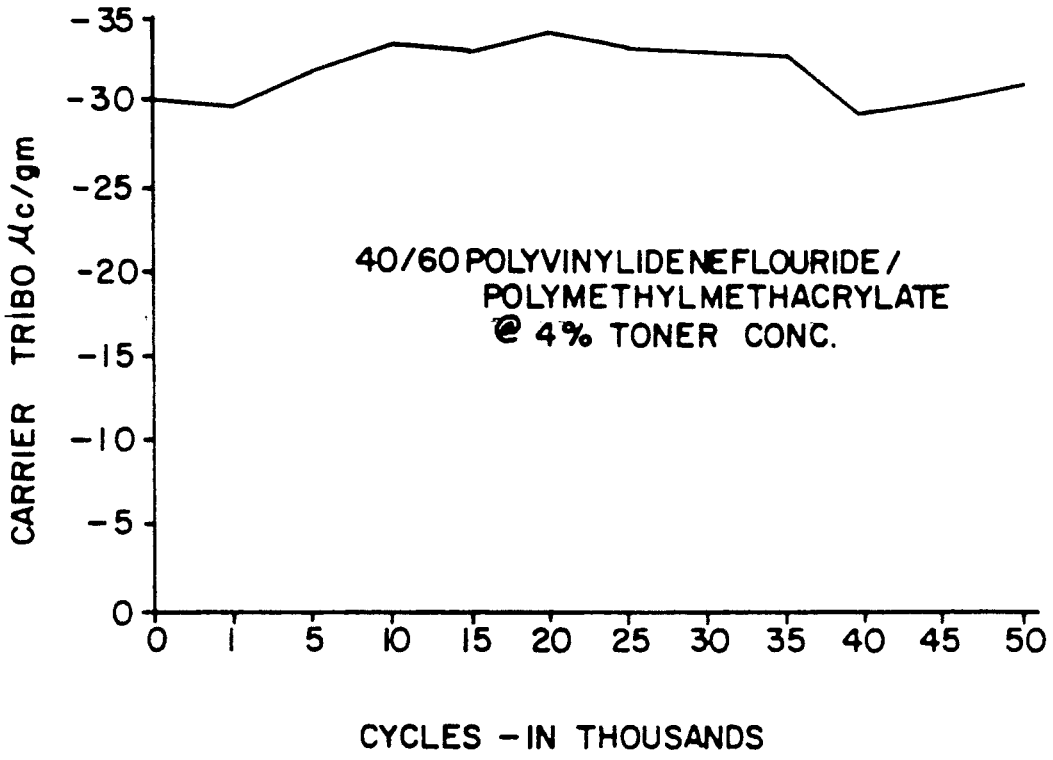

This is a division of application Ser. No. 136,791, filed Dec. 22, 1987, now U.S. Pat. No. 4,937,166, which is a continuation-in-part of U.S. Ser. No. 793,042, filed Oct. 30, 1985, and entitled Developer Compositions With Coated Carrier Particles, the disclosure of which is totally incorporated herein by reference.

BACKGROUND OF THE INVENTION

This invention is generally directed to developer compositions, and more specifically, the present invention relates to developer compositions with coated carrier particles prepared by a dry powder process. In one embodiment of the present invention the carrier particles are comprised of a core with coating thereover generated from a mixture of polymers that are not in close proximity thereto in the triboelectric series. Moreover, in another aspect of the present invention the carrier particles are prepared by a dry coating process wherein a mixture of certain polymers are applied to the carrier enabling insulating particles with relatively constant conductivity parameters; and also wherein the triboelectric charge on the carrier can vary significantly depending on the coatings selected. Developer compositions comprised of the carrier particles prepared by the dry coating process of the present invention are useful in electrostatographic or electrophotographic imaging systems, especially xerographic imaging processes. Additionally, developer compositions comprised of substantially insulating carrier particles prepared in accordance with the process of the present invention are useful in imaging methods wherein relatively constant conductivity parameters are desired. Furthermore, in the aforementioned imaging processes the triboelectric charge on the carrier particles can be preselected depending on the polymer composition applied to the carrier core.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith, as it is these values that enable continued constant developed images of high quality and excellent resolution.

Additionally, carrier particles for use in the development of electrostatic latent images are described in many patents including, for example U.S. Pat. No. 3,590,000. These carrier particles may consist of various cores, including steel, with a coating thereover of fluoropolymers; and terpolymers of styrene, methacrylate, and silane compounds. Recent efforts have focused on the attainment of coatings for carrier particles, for the purpose of improving development quality; and also to permit particles that can be recycled, and that do not adversely effect the imaging member in any substantial manner. Many of the present commercial coatings can deteriorate rapidly, especially when selected for a continuous xerographic process where the entire coating may separate from the carrier core in the form of chips or flakes; and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There is also illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns, with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent, the disclosure of which has been totally incorporated herein by reference, are suitable for their intended purposes, the conductivity values of the resulting particles are not constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, the conductivity of the resulting carrier particles are substantially constant, and moreover the triboelectric values can be selected to vary significantly, for example, from less than −15 microcoulombs per gram to greater than −70 microcoulombs per gram, depending on the polymer mixture selected for affecting the coating process.

With further reference to the prior art, carriers obtained by applying insulating resinous coatings to porous metallic carrier cores using solution coating techniques are undersirable from many viewpoints. For example, the coating material will usually reside in the pores of the carrier cores, rather than at the surfaces thereof; and therefore is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further usually these processes result in low product yields. Also, solution coated carrier particles when combined and mixed with finely divided toner particles provide in some instances triboelectric charging values which are too low for many uses. The powder coating process of the present invention overcomes these disadvantages, and further enables developer mixtures that are capable of generating high and useful triboelectric charging values with finely divided toner particles; and also wherein the carrier particles are of substantially constant conductivity. Further, when resin coated carrier particles are prepared by the powder coating process of the present invention, the majority of the coating materials are fused to the carrier surface thereby reducing the number of toner impaction sites on the carrier material. Additionally, there can be achieved with the process of the present invention, independent of one another, desirable triboelectric charging characteristics and conductivity values; that is, for example the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

Thus, for example, there can be formulated in accordance with the invention of the present application developers with conductivities of from about $10^{-6}$ mho $(cm)^{-1}$ to $10^{-17}$ mho $(cm)^{-1}$ as determined in a magnetic brush conducting cell; and triboelectric charging values of from about a $-8$ to a $-80$ microcoulombs per gram on the carrier particles as determined by the known Faraday cage technique. Thus, the developers of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by retaining the polymer ratio coating constant and modifying the coating weight for the carrier particles.

Other patents of interest include U.S. Pat. No. 3,939,086, which teaches steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; and 4,434,220.

SUMMARY OF THE INVENTION

It is an object of the present invention to provide toner and developer compositions with carrier particles containing a polymer mixture coating.

In another object of the present invention there are provided dry coating processes for generating carrier particles of substantially constant conductivity parameters.

In yet another object of the present invention there are provided dry coating processes for generating carrier particles of substantially constant conductivity parameters, and a wide range of preselected triboelectric charging values.

In yet a further object of the present invention there are provided carrier particles comprised of a coating with a mixture of polymers that are not in close proximity, that is for example, a mixture of polymers from different positions in the triboelectric series.

In still a further object of the present invention there are provided carrier particles of insulating characteristics comprised of a core with a coating thereover generated from a mixture of polymers.

Further, in an additional object of the present invention there are provided carrier particles comprised of a core with a coating thereover generated from a mixture of polymers wherein the triboelectric charging values are from about $-10$ microcoulombs to about $-70$ microcoulombs per gram at the same coating weight.

In another object of the present invention there are provided methods for the development of electrostatic latent images wherein the developer mixture comprises carrier particles with a coating thereover consisting of a mixture of polymers that are not in close proximity in the triboelectric series.

Also, in another object of the present invention there are provided positively charged toner compositions, or negatively charged toner compositions having incorporated therein carrier particles with a coating thereover of a mixture of certain polymers.

These and other objects of the present invention are accomplished by providing developer compositions comprised of toner particles, and carrier particles prepared by a powder coating process; and wherein the carrier particles consist of a core with a coating thereover comprised of a mixture of polymers. More specifically, the carrier particles selected can be prepared by mixing low density porous magnetic, or magnetically attractable metal core carrier particles with from, for example, between about 0.05 percent and about 3 percent by weight, based on the weight of the coated carrier particles, of a mixture of polymers until adherence thereof to the carrier core by mechanical impaction or electrostatic attraction; heating the mixture of carrier core particles and polymers to a temperature, for example, of between from about 200° F. to about 550° F., for a period of from about 10 minutes to about 60 minutes enabling the polymers to melt and fuse to the carrier core particles; cooling the coated carrier particles; and thereafter classifying the obtained carrier particles to a desired particle size.

In a specific embodiment of the present invention there are provided carrier particles comprised of a core with a coating thereover comprised of a mixture of a first dry polymer component and a second dry polymer component, which are not in close proximity in the triboelectric series. Therefore, the aforementioned carrier compositions can be comprised of known core materials including iron with a dry polymer coating mixture thereover. Subsequently, developer compositions of the present invention can be generated by admixing the aforementioned carrier particles with a toner composition comprised of resin particles and pigment particles.

Various suitable solid core carrier materials can be selected providing the objectives of the present invention are obtained. Characteristic core properties of importance include those that will enable the toner particles to acquire a positive charge or a negative charge; and carrier cores that will permit desirable flow properties in the developer reservoir present in the xerographic imaging apparatus. Also of value with regard to the carrier core properties are, for example, suitable magnetic characteristics that will permit magnetic brush formation in mag brush development processes; and also wherein the carrier cores possess desirable mechanical aging characteristics. Examples of carrier cores that can be selected include iron, steel, ferrites, magnetites, nickel, and mixtures thereof. Preferred carrier cores include ferrites, and sponge iron, or steel grit with an average particle size diameter of from between about 30 microns to about 200 microns.

Illustrative examples of polymer coatings selected for for the carrier particles of the present invention include those that are not in close proximity in the triboelectric series. Specific examples of polymer mixtures used are polyvinylidenefluoride with polyethylene; polymethylmethacrylate and copolyethylenevinylacetate; copolyvinylidenefluoride tetrafluoroethylene and polyethylene; polymethylmethacrylate and copolyethylene vinylacetate; and polymethylmethacrylate and polyvinylidenefluoride. Other related polymer mixtures not specifically mentioned herein can be selected providing the objectives of the present invention are achieved, including for example polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate.

With further reference to the polymer coating mixture, by close proximity as used herein it is meant that the choice of the polymers selected are dictated by their position in the triboelectric series, therefore for example, one may select a first polymer with a significantly lower triboelectric charging value than the second polymer. For example, the triboelectric charge of a steel carrier core with a polyvinylidenefluoride coating is about −75 microcoulombs per gram. However, the same carrier, with the exception that there is selected a coating of polyethylene, has a triboelectric charging value of about −17 microcoulombs per gram. More specifically, not in close proximity refers to first and second polymers that are at different electronic work function values, that is they are not at the same electronic work function value; and further, the first and second polymers are comprised of different components. Additionally, the difference in electronic work functions between the first and second polymer is at least 0.2 electron volt, and preferably is about 2 electron volts; and moreover, it is known that the triboelectric series corresponds to the known electronic work function series for polymers, reference "Electrical Properties of Polymers", Seanor, D. A., Chapter 17, *Polymer Science*, A. D. Jenkins, Editor, North Holland Publishing (1972, the disclosure of which is totally incorporated herein by reference.

The percentage of each polymer present in the carrier coating mixture can vary depending on the specific components selected, the coating weight and the properties desired. Generally, the coated polymer mixtures used contains from about 10 to about 90 percent of the first polymer, and from about 90 to about 10 percent by weight of the second polymer. Preferably, there are selected mixtures of polymers with from about 40 to 60 percent by weight of the first polymer, and from about 60 to 40 percent by weight of a second polymer. In one embodiment of the present invention, when a high triboelectric charging value is desired, that is, exceeding −50 microcoulombs per gram, there is selected from about 90 percent by weight of the first polymer such as polyvinylidenefluoride; and 10 percent by weight of the second polymer such as polyethylene. In contrast, when a lower triboelectric charging value is required, less than about −20 microcoulombs per gram, there is selected from about 10 percent by weight of the first polymer; and 90 percent by weight of the second polymer.

Also, these results, in accordance with a preferred embodiment of the present invention, carrier particles of relatively constant conductivities from between about $10^{-15}$ mho-cm$^{-1}$ to from about $10^{-9}$ mho-cm$^{-1}$ at, for example, a 10 volt impact across a 0.1 inch gap containing carrier beads held in place by a magnet; and wherein the carrier particles are of a triboelectric charging value of from −15 microcoulombs per gram to −70 microcoulombs per gram, these parameters being dependent on the coatings selected, and the percentage of each of the polymers used as indicated hereinbefore.

Various effective suitable means can be used to apply the polymer mixture coatings to the surface of the carrier particles. Examples of typical means for this purpose include combining the carrier core material, and the mixture of polymers by cascade roll mixing, or tumbling, milling, shaking, electrostatic powder cloud spraying, fluidized bed, electrostatic disc processing, and an electrostatic curtain. Following application of the polymer mixture, heating is initiated to permit flow-out of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated. When selected areas of the metal carrier core remain uncoated or exposed, the carrier particles will possess electrically conductive properties when the core material comprises metal. The aforementioned conductivities can include various suitable values. Generally, however, this conductivity is from about $10^{-9}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core.

Illustrative examples of finely divided toner resins selected for the developer compositions of the present invention include polyamides, epoxies, polyurethanes, diolefins, vinyl resins and polymeric esterification products of a dicarboxylic acid and a diol comprising a diphenol. Specific vinyl monomers that can be used are styrene, p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether, vinyl ketones inclusive of vinyl methyl ketone, vinyl hexyl ketone and methyl isopropenyl ketone; vinylidene halides such as vinylidene chloride, and vinylidene chlorofluoride; N-vinyl indole, N-vinyl pyrrolidene; styrene butadiene copolymers; mixtures thereof; and other similar substances.

As one preferred toner resin there can be selected the esterification products of a dicarboxylic acid and a diol comprising a diphenol, reference U.S. Pat. No. 3,590,000 the disclosure of which is totally incorporated herein by reference. Other preferred toner resins include styrene/methacrylate copolymers; styrene/-butadiene copolymers; polyester resins obtained from the reaction of bisphenol A and propylene oxide; and branched polyester resins resulting from the reaction of dimethylterephthalate, 1,3-butanediol, 1,2-propanediol and pentaerthriol.

Generally, from about 1 part to about 5 parts by weight of toner particles are mixed with from about 10 to about 300 parts by weight of the carrier particles prepared in accordance with the process of the present invention.

Numerous well known suitable pigments or dyes can be selected as the colorant for the toner particles including, for example, carbon black, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 3 percent by weight to about 20 percent by weight, based on the total weight of the toner composition, however, lesser or greater amounts of pigment particles can be selected providing the objectives of the present invention are achieved.

When the pigment particles are comprised of magnetites, which are a mixture of iron oxides ($FeO.Fe_2O_3$) including those commercially available as Mapico Black, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin material is selected. Generally, however, providing the objectives of the present invention are achieved, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner compositions comprised of toner resin particles, carrier particles and as pigments or colorants, magenta, cyan and/or yellow particles, as well as mixtures thereof. More specifically, illustrative examples of magenta materials that may be selected as pigments include 1,9-dimethyl-substituted quinacridone and anthraquinone dye identified in the color index as Cl 60720, CI Dispersed Red 15, a diazo dye identified in the color index as Cl 26050, Cl Solvent Red 19, and the like. Examples of cyan materials that may be used as pigments include copper tetra-4(octaecyl sulfonamido) phthalocyanine, X-copper phthalocyanine pigment listed in the color index as Cl 74160, Cl Pigment Blue, and Anthrathrene Blue, identified in the color index as Cl 69810, Special Blue X-2137, and the like; while illustrative examples of yellow pigments that may be selected are diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl Dispersed Yellow 33, 2,5-dimethoxy-4-sulfonanilide phenylazo-4'-chloro-2,5-dimethoxy aceto-acetanilide, permanent yellow FGL, and the like. These pigments are generally present in the toner composition an amount of from about 1 weight percent to about 15 weight percent based on the weight of the toner resin particles.

For further enhancing the positive charging characteristics of the developer compositions described herein, and as optional components there can be incorporated herein charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; copending application Ser. No. 645,660, entitled Toner Compositions with Ammonium Sulfate Charge Enhancing Additives, the disclosure of which is totally incorporated herein by reference; and other similar known charge enhancing additives. These additives are usually incorporated into the toner in an amount of from about 0.1 percent by weight to about 20 percent by weight.

The toner composition of the present invention can be prepared by a number of known methods including melt blending the toner resin particles, and pigment particles or colorants of the present invention followed by mechanical attrition. Other methods include those well known in the art such as spray drying, melt dispersion, dispersion polymerization and suspension polymerization. In one dispersion polymerization method, a solvent dispersion of the resin particles and the pigment particles are spray dried under controlled conditions to result in the desired product.

Also, the toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in the '990 patent. Also, there can be selected as photogenerating pigments, squaraine compounds, thiapyrillium materials, and the like. These layered members are conventionally charged negatively thus requiring a positively charged toner. Other photoresponsive devices useful in the present invention include polyvinylcarbazole 4-dimethylaminobenzylidene, benzhydrazide; 2-benzylideneaminocarbazole, 4-dimethamino-benzylidene, (2-nitrobenzylidene)-p-bromoaniline; 2,4-diphenylquinazoline; 1,2,4-triazine; 1,5-diphenyl-3-methyl pyrazoline 2- (4'-dimethylaminophenyl)benzoaxzole; 3-aminocarbazole, polyvinyl carbazole-trinitrofluorenone charge transfer complex; and mixtures thereof. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. No. 4,394,429 and 4,368,970, the disclosures of which are totally incorporated herein by reference.

Images obtained with this developer composition had acceptable solids, excellent halftones and desirable line resolution, with acceptable or substantially no background deposits.

With further reference to the process for generating the carrier particles illustrated herein, there is initially obtained, usually from commercial sources, the uncoated carrier core and the polymer powder mixture coating. The individual components for the coating are available, for example, from Pennwalt, as 301F Kynar, Allied Chemical, as Polymist B6, and other sources. Generally, these polymers are blended in various proportions as mentioned hereinbefore as, for example, in a ratio of 1:1, 0.1 to 0.9; and 0.5 to 0.5. The blending can be accomplished by numerous known methods including, for example, a twin shell mixing apparatus. Thereafter, the carrier core polymer blend is incorporated into a mixing apparatus, about 1 percent by weight of the powder to the core by weight in a preferred embodiment and mixing is affected for a sufficient period of time until the polymer blend is uniformly distributed over the carrier core, and mechanically or electrostatically attached thereto. Subsequently, the resulting coated carrier particles are metered into a rotating tube furnace, which is maintained at a sufficient temperature to cause melting and fusing of the polymer blend to the carrier core.

Illustrated in FIG. 1 is a graph plotting the negative triboelectric charge of the carrier in microcoulombs per gram versus imaging cycles in thousands with a developer composition comprised of 4 percent by weight of a toner composition containing styrene butadiene, 78 percent by weight; magnetite commercially available as Mapico Black, 16 percent by weight; 4 percent by weight of carbon black; and 2 percent by weight of the charge enhancing additive distearyl dimethyl ammonium methyl sulfate; and 96 percent by weight of carrier particles consisting of a steel core with a coating thereover; 0.7 percent by weight of a polymer blend consisting of 40 percent by weight of polyvinylidenefluoride and 60 percent by weight of polymethylmethacrylate. The values reported on this graph were obtained in a Xerox Corporation imaging test fixture with a photoreceptor imaging member comprised of aluminum, a photogenerating layer of trigonal selenium dispersed in polyvinyl carbazole thereover, and a charge transport layer of N,N'-diphenyl-N,N'-bis(3-methylphenyl)[1,1-biphenyl]-4,4'-diamine, 50 percent by weight dispersed in 50 percent by weight of polycarbonate. This graph thus indicates that the triboelectric charge, and by inference the carrier coating ratio present remains relatively constant, that is, about −30 for slightly more than 50,000 imaging cycles, with a 40 to 60 polymer ratio percent weight.

Figure 2:
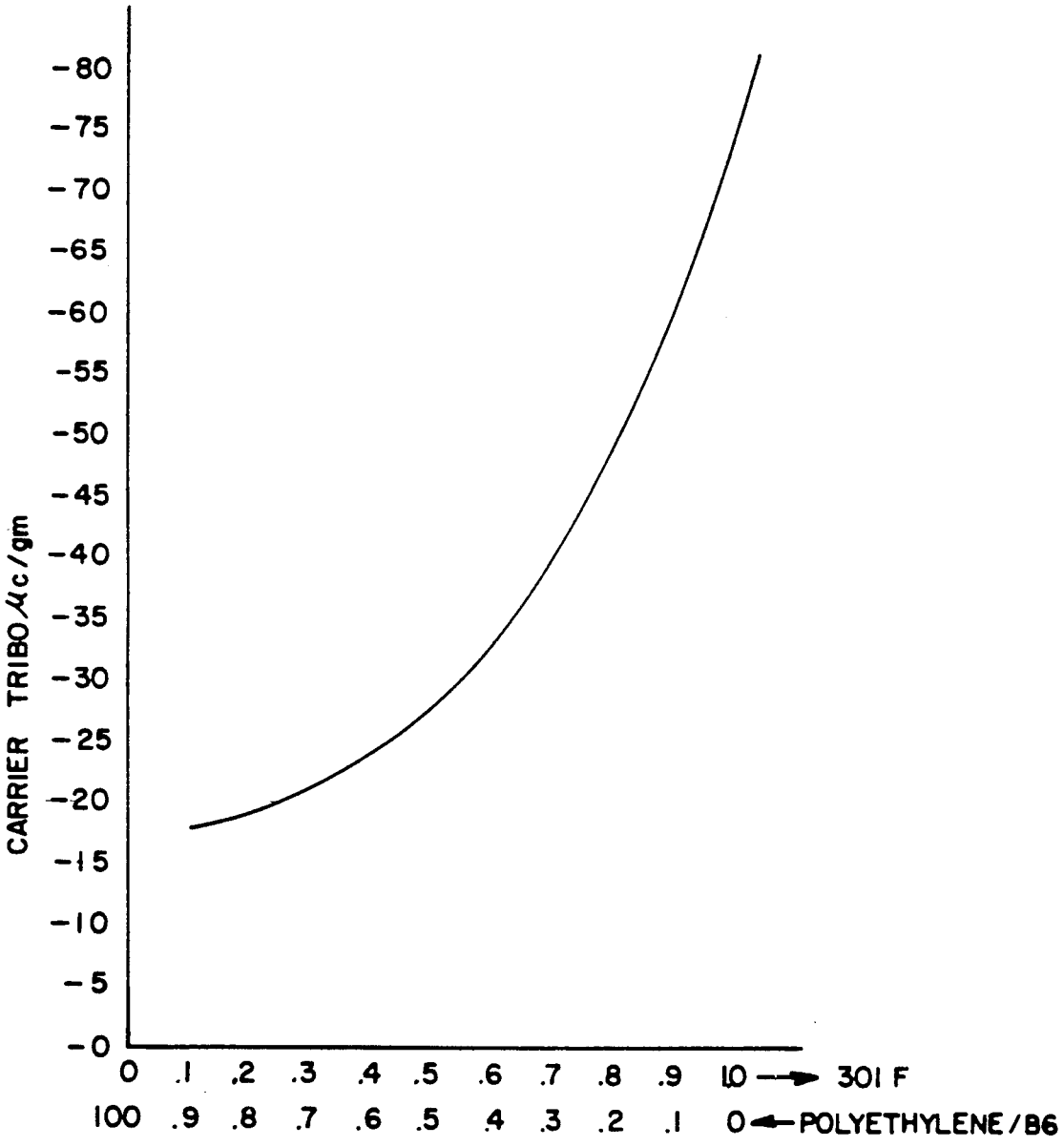

Illustrated in FIG. 2 is a plot generated in a Faraday Cage, in accordance with the procedure illustrated hereinafter, of the negative triboelectric charging values of carrier particles comprised of a steel core with various polymer ratios thereover of 301F polyvinylidenefluoride, and polyethylene B6 available from Allied Chemical, which values were at a 1 percent coating weight.

Also, there can be obtained in accordance with the process of the present invention carrier particles with positive triboelectric charging values thereon of from about 10 to about 80 microcoulombs per gram by, for example, selecting as carrier coatings polyethylene, and polymethylmethacrylates.

The following examples are being supplied to further define the present invention, it being noted that these examples are intended to illustrate and not limit the scope of the present invention. Parts and percentages are by weight unless otherwise indicated.

EXAMPLE I

There was prepared carrier particles by coating 68,040 grams of a Toniolo atomized steel core, 120 microns in diameter, with 680 grams of a polyvinylidenefluoride, available as Kynar 301F, 1 percent coating weight, by mixing these components for 60 minutes in a Munson MX-1 Minimixer, rotating at 27.5 RPM. There resulted uniformly distributed and electrostatically attached, as determined by visual observation, on the carrier core the polyvinylidenefluoride. Thereafter, the resulting carrier particles were metered into a rotating tube furnace at a rate of 105 grams/min. This furnace was maintained at a temperature of 503° F. thereby causing the polymer to melt and fuse to the core.

A developer composition was then prepared by mixing 97.5 grams of the above prepared carrier particles with 2.5 grams of a toner composition comprised of 92 percent by weight of a styrene n-butylmethacrylate copolymer resin, 58 percent by weight of styrene, 42 percent by weight of n-butylmethacrylate, and 10 percent by weight of carbon black, and 2 percent by weight of the charge additive cetyl pyridinium chloride. Thereafter, the triboelectric charge on the carrier particles was determined by the known Faraday Cage process, and there was measured on the carrier a charge of −68.3 microcoulombs per gram. Further, the conductivity of the carrier as determined by forming a 0.1 inch long magnetic brush of the carrier particles, and measuring the conductivity by imposing a 10 volt potential across the brush, was $10^{-15}$ mho-cm$^{-1}$. Therefore, these carrier particles are insulating.

In all the working examples, the triboelectric charging values and the conductivity numbers were obtained in accordance with the aforementioned procedure.

EXAMPLE II

The procedure of Example I was repeated with the exception that 102.0 grams, 0.15 percent coating weight, of polyvinylfluoride was used. There resulted on the carrier particles a triboelectric charge thereon of −33.7 microcoulombs per gram. Also, the carrier particles had a conductivity of $10^{-9}$ mho-cm$^{-1}$. Thus, these particles are considered conductive. Therefore, by changing the coating weight from 1 percent to 0.15 percent, there is a significant conductivity change; that is, the carrier particles are converted from being insulating, reference Example I, to being conductive, reference the present Example, and the triboelectric value increased from −68.3 to −33.7.

EXAMPLE III

A developer composition of the present invention was prepared by repeating the procedure of Example I with the exception that there was selected as the carrier coating 680 grams of a polymer blend at a 1.0 percent coating weight of a polymer mixture, ratio 1:9 of polyvinylidenefluoride, Kynar 301F, and polyethylene, available as Polymist B6 from Allied Chemical. There resulted on the carrier particles a triboelectric charge of −17.6 microcoulombs per gram. Also, the carrier particles were insulating in that they had a conductivity of $10^{-15}$ mho-cm$^{-1}$.

Therefore, there results carrier particles that are insulating and with a relatively low tribo, namely −17.6 microcoulombs per gram.

EXAMPLE IV

A developer composition was prepared by repeating the procedure of Example III with the exception that there was selected as the carrier coating of a polymer mixture, ratio 9:1, of polyvinylidenefluoride, Kynar 301F, and polyethylene, available as Polymist B6. About 680 grams of the polymer blend, that is a 1.0 percent coating weight, was selected. There resulted on the carrier particles a triboelectric charge of −63 microcoulombs per gram, and the insulating carrier particles had a conductivity of $10^{-15}$ mho-cm$^{-1}$.

Therefore, for example, in comparison to the developer of Example III with a polymer blend ratio of 9 to 1, instead of 1 to 9, there was obtained insulating carrier particles with a higher negative triboelectric charge, namely −63 microcoulombs per gram as compared to −17.6 microcoulombs per gram with reference to the developer of Example III.

EXAMPLE V

A developer composition was prepared by repeating the procedure of Example III with the exception that there was selected as the carrier coating a blend, ratio 3:2, of a polymer mixture of polyvinylidenefluoride, Kynar 301F, and high density 0.962 grams/milliliters, of polyethylene FA520, available from USI Chemical Company. About 340 grams of the polymer blend, that is a 0.5 percent coating weight, was added. There resulted on the carrier particles a triboelectric charge of −29.8 microcoulombs per gram. Also, the resulting insulating carrier particles had a conductivity of $10^{-14}$ mho-cm$^{-1}$.

EXAMPLE VI

A developer composition was prepared by repeating the procedure of Example III with the exception that there was selected as the carrier coating a blend, ratio 7:3, of a polymer mixture of copolyvinylidenefluoride tetrafluoroethylene, available from Pennwalt as Kynar 7201, and a high density, 0.962 grams per milliliter, of polyethylene available as Microthene FA520 from USI Chemicals Company. About 272 grams of the polymer blend, that is a 0.4 percent coating weight, was added. There resulted on the carrier particles a triboelectric charge of −47.6 microcoulombs per gram. Also, the resulting insulating carrier particles had a conductivity of $10^{-14}$ mho-cm$^{-1}$.

EXAMPLE VII

A developer composition was prepared by repeating the procedure of Example VI with the exception that there was selected as the carrier coating a blend, ratio 7:3, a polymer mixture of copolyvinylidenefluoride tetrafluoroethylene, available from Pennwalt as Kynar 7201, and a low density, 0.924 grams per milliliter, polyethylene available from USI Chemicals Company as FN510. About 476 grams of the polymer blend, that is a 0.7 percent coating weight, was added. There resulted on the carrier particles a triboelectric charge of −42 microcoulombs per gram. Also, the resulting insulating carrier particles had a conductivity of $10^{-15}$ mho-cm$^{-1}$.

EXAMPLE VIII

A developer composition was prepared by repeating the procedure of Example IV with the exception that there was selected as the carrier coating a blend, ratio 7:3, of a polymer mixture of Kynar 7201, and a copolyethylene vinylacetate, available from USI Chemical Company as FE532. About 476 grams of the polymer blend, that is a 0.7 percent coating weight, was added. There resulted on the carrier particles a triboelectric charge of −33.7 microcoulombs per gram. Also, the resulting insulating carrier particles had a conductivity of $10^{-15}$ mho-cm$^{-1}$.

EXAMPLE IX

A developer composition was prepared by repeating the procedure of Example VIII with the exception that there was selected as the carrier coating a blend, ratio of 2:3, of a polymer mixture of a polyvinylidenefluoride available from Pennwalt as Kynar 301F, and a polymethacrylate available from Fuji Xerox. About 476 grams of the polymer blend, that is a 0.7 percent coating weight, was added. There resulted on the carrier particles a triboelectric charge of −29.5 microcoulombs per gram. Also, the resulting insulating carrier particles had a conductivity of $10^{-15}$ mho-cm$^{-1}$.

With further reference to the above Examples, the conductivity values were obtained as indicated herein. Specifically, these values were generated by the formation of a magnetic brush with the prepared carrier particles. The brush was present within a one electrode cell consisting of the magnet as one electrode and a nonmagnetic steel surface as the opposite electrode. A gap of 0.100 inch was maintained between the two electrodes and a 10 volt bias was applied in this gap. The resulting current through the brush was recorded and the conductivity is calculated based on the measured current and geometry.

More specifically, the conductivity in mho-cm$^{-1}$ is the product of the current, and the thickness of the brush, about 0.254 centimeters divided by the product of the applied voltage and the effective electrode area.

With insulating developers, there are usually obtained images of high copy quality with respect to both lines and halftones, however, solid areas are of substantially lower quality. In contrast, with conductive developers there are achieved enhanced solid areas with low line resolution and inferior halftones.

With respect to the triboelectric numbers in microcoulombs per gram, they were determined by placing the developer materials in an 8 oz. glass jar, with 2.75 percent by weight toner compositions, placed on a Red Devil Paint Shaker and agitated for 10 minutes. Subsequently, the jar was removed and samples from the jar were placed in a known tribo Faraday Cage apparatus. The blow off tribo of the carrier particles was then measured.

Other modifications of the present invention may occur to those skilled in the art based upon a reading of the present disclosure and these modifications are intended to be included within the scope of the present invention.

What is claimed is:

1. A developer composition comprised of carrier particles comprised of a core with a coating thereover comprised of a mixture of first and second polymers that are not in close proximity thereto in the triboelectric series wherein the triboelectric charging properties of the carrier are independent of the conductivities thereof, said triboelectric properties being dependent on the ratio of polymers present, and said conductivities being dependent on the coating weight of the polymers selected, and a toner composition of toner resin particles and pigment particles.

2. A developer composition in accordance with claim 1 wherein the toner resin is comprised of styrene polymers.

3. A developer composition in accordance with claim 2 wherein the styrene polymers are selected from the group consisting of styrene methacrylates and styrene acrylates.

4. A developer composition in accordance with claim 1 wherein the toner resin is selected from the group consisting of polyesters and styrene butadienes.

5. A developer composition in accordance with claim 1 wherein the pigment particles are carbon black.

6. A developer composition in accordance with claim 1 wherein the toner contains therein charge enhancing additives.

7. A developer composition in accordance with claim 6 wherein the charge enhancing additive is selected from alkyl pyridinium halides, organic sulfate and sulfonate compositions, and distearyl dimethyl ammonium methyl sulfate.

8. A developer composition in accordance with claim 1 wherein the carrier core is selected from the group consisting of iron, ferrites, steel and nickel.

9. A developer composition in accordance with claim 1 wherein the first polymer is present in an amount of from about 40 percent by weight to about 60 percent by weight, and the second polymer is present in an amount of from about 60 percent by weight to about 40 percent by weight.

* * * * *